US006017162A

United States Patent [19]

Call

[11] Patent Number: 6,017,162

[45] Date of Patent: Jan. 25, 2000

[54] LOTION DISPENSING SYSTEM

[76] Inventor: Sherry L. Call, 167 SE. 1181, Knob Noster, Mo. 65336

[21] Appl. No.: 09/177,542

[22] Filed: Oct. 22, 1998

[51] Int. Cl.[7] ..... A45D 34/00

[52] U.S. Cl. ..... 401/6; 401/208; 401/220

[58] Field of Search ..... 401/6, 220, 219, 401/208

[56] References Cited

U.S. PATENT DOCUMENTS

| | | | |
|---|---|---|---|
| D. 252,219 | 6/1979 | Peeples | 401/6 X |
| D. 333,191 | 2/1993 | Rainer | 401/6 X |
| D. 352,130 | 11/1994 | Zierhut | 401/6 X |
| 2,250,692 | 7/1941 | Wise | 401/220 |
| 3,182,347 | 5/1965 | Haines | 401/220 |
| 3,850,532 | 11/1974 | Kaiser | 401/219 |
| 4,150,904 | 4/1979 | Stewart | 401/6 X |
| 4,555,196 | 11/1985 | DeGarmo | 401/220 |
| 5,088,849 | 2/1992 | Johnson et la. | 401/44 |
| 5,388,700 | 2/1995 | Per-Lee | 206/581 |
| 5,568,669 | 10/1996 | Godown | 15/143.1 |
| 5,615,962 | 4/1997 | Staub | 401/173 |
| 5,659,916 | 8/1997 | Beatly et al. | 15/210.1 |
| 5,795,279 | 8/1998 | Shieh | 401/208 X |

*Primary Examiner*—Steven A. Bratlie
*Attorney, Agent, or Firm*—Joseph N. Breaux

[57] ABSTRACT

A lotion dispensing system comprising a handle. A housing at a bottom end of the handle has a reservoir therein for holding lotion. An applicator roller assembly is provided. A structure is for rotatively mounting the applicator roller assembly to a lower end of the housing. A facility is for distributing the lotion from the reservoir within the housing to the applicator roller assembly for application onto a human body upon contact with the applicator roller assembly.

1 Claim, 1 Drawing Sheet

LOTION DISPENSING SYSTEM

TECHNICAL FIELD

The present invention relates to lotion applicators and more particularly to a lotion dispensing system. The lotion dispensing system comprises a handle, a housing with a lotion reservoir, an applicator roller assembly rotatively mounted to the housing, so that lotion can be distributed to the roller assembly for application onto a human body.

BACKGROUND ART

Numerous lotion applicators have been provided in prior art. For example, U.S. Pat. Nos. 4,555,196 to DeGarmo; 5,088,849 to Johnson et al.; 5,388,700 to Per-Lee; 5,568,669 to Godown; 5,615,962 to Staub and 5,659,916 to Beatty et al. and are illustrative of such prior art. While these units may be suitable for the particular purpose to which they address, they would not be as suitable for the purposes of the present invention as heretofore described.

The DeGarmo U.S. Pat. No. 4,555,196 discloses a tanning wand. A tanning wand for dispensing tanning oil and the like from a container is provided and consists of a housing having a pair of opposite extending end walls, a resilient roller rotatively mounted to the housing between the end walls, a tube having a threaded opening in bottom of the tube that mates with a threaded neck of the container, a T-shaped passage and a plurality of soft bristle brushes for directing the tanning oil through the housing onto the roller along an entire portion of a contact surface thereof, a stop cock for controlling the tanning oil flow through the T-shaped passage of the housing and a guard that snaps on the housing over the roller between the end walls.

The Johnson et al. U.S. Pat. No. 5,088,849 discloses an applicator for applying liquids to the human body. An applicator for applying a plurality of liquids, such as for tanning, at the same time to the human body. The applicator includes a handle and an applicator head at the top of the handle. The head receives a pad for contact with the body where the liquids are to be applied. The handle has at least two chambers for separately containing the liquids. The liquids are fed from the chambers to the applicator pad for application to the body upon contact with the pad.

The Per-Lee U.S. Pat. No. 5,388,700 discloses an applicator device. A device for applying skin treatment substances to the back of a person includes a manually grippable elongated shaft having a head formed thereon, and a plurality of contact pads, each selectively engageable with and disengageable from the head without damaging the head or pads. A first contact pad has a non-porous contact surface for applying relatively viscous substances to the skin of the person, a second contact pad has a porous contact surface for retaining relatively non-viscous substances for applying the relatively non-viscous substance to the skin of the person, and a third contact pad has a sisal contact surface for cleansing the skin of the person. Also, a fourth contact pad has an erose surface for gently scratching the person's back when rubbed against it. A bag is provided for holding the shaft and contact pads.

The Godown U.S. Pat. No. 5,568,669 discloses a lotion applicator. An applicator for use in applying lot on comprises a housing, a handle and an applicator pad. The housing is hollow so as to receive the handle therein when the handle is being stored. The applicator pad is attached to the housing and is used to spread lotion, such as suntan lotion, on one's back. The end of the handle has a locking ring, endplug or endcap that is designed to hold by friction the handle to the housing, either in the stored position with the handle in the housing, or in the extended position for use. The applicator pad has an annular depression to enable the pad to control the spread of the lotion. Lotion is spread toward the depression by the higher center and thus over the pad, but the excess lotion is confined to it by the higher edge of the pad. The present applicator will enable more efficient application of lotion by applying all of it rather than absorbing part of it.

The Staub U.S. Pat. No. 5,615,962 discloses a lotion applicator. A device for applying lotions, creams and similar substances to any part of the body, particularly to the back and other difficult-to-reach areas is provided. The applicating device comprises three basic components; a one-piece frame having an elongated handle portion at one end and a reservoir retaining means at the distal end thereof, a pressure applying lid having top, central and bottom portions and a removable flexible reservoir having a porous, permeable or perforated applicator surface. The pressure applying lid and retaining means are configured to interact thereby advancing the lotion through the applicator surface. The applicator surface has a convex curvature which is substantially identical to the curvature of the bottom portion of the pressure applying lid, thereby minimizing waste of the Let on.

The Beatty et al. U.S. Pat. No. 5,659,916 discloses a lotion applicator. An improved handle relating generally to applicators for applying body lotions is provided, wherein the handle may be easily held and retained by a user with limited gripping strength or limited gripping ability due to arthritis and other physically challenging limitations, for instance. A preferred embodiment of the improved handle comprises a curved elongated shaft having a gripping portion integral to one end and a pivotal mounting port on for mounting an applicator pad to an opposing end. The gripping portion defines an orifice, preferably D-shaped, through which fingers or a thumb of a hand may be inserted for damping of the gripping portion between the fingers and the thumb. The gripping portion provides multiple subshafts separated by integral sidewalls. Retaining stability is provided according to the position that the user desires to maneuver the elongated shaft by cooperatively integrating the fingers, the thumb, and a waist portion of the hand around, within, against, or about the multiple subshafts, thereby to enhance retention of the gripping portion, and thus the handle, by the hand having limited gripping ability.

GENERAL SUMMARY DISCUSSION OF INVENTION

The lotion dispensing system includes an ergonomic telescoping handle, a housing having a reservoir and an applicator roller assembly. The applicator roller assembly is rotatively attached to a lower end of the housing, fitting snugly up against a longitudinal slot along the length of the housing, allowing lotion to coat the applicator roller assembly as it rotates. The applicator roller assembly can be removed for cleaning and replacement. The handle telescopes in and out, allowing the user to extend the handle as required during use and to retract the handle for storage and transport. The handle also features a bend or curvature in the center section, allowing the user to easily reach various portions of the human body, such as a lower area of their back from over the shoulder. The lotion dispensing system could also contain a slip-on protective cover to protect the applicator roller assembly from picking up dirt and other contaminants when not in use.

A primary object of the present invention is to provide a lotion dispensing system that will overcome the shortcomings of the prior art devices.

Another object is to provide a lotion dispensing system in which the concept of the present invention is that of a lotion applicator for a back of a person.

An additional object is to provide a lotion dispensing system that is a specially designed lotion applicator with an ergonomic telescoping handle, a housing having a lotion reservoir and an applicator roller assembly which will allow the user to easily roll lotion onto their back without assistance.

A further object is to provide a lotion dispensing system that is simple and easy to use.

A still further object is to provide a lotion dispensing system that is economical in cost to manufacture.

Further objects of the invention will appear as the description proceeds.

To the accomplishment of the above and related objects, this invention may be embodied in the form Illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

For a further understanding of the nature and objects of the present invention, reference should be had to the following detailed description, taken in conjunction with the accompanying drawings, in which like elements are given the same or analogous reference numbers and wherein.

Similar reference characters denote corresponding features consistently throughout the attached drawings.

EXEMPLARY MODE FOR CARRYING OUT THE INVENTION

Figure 1:
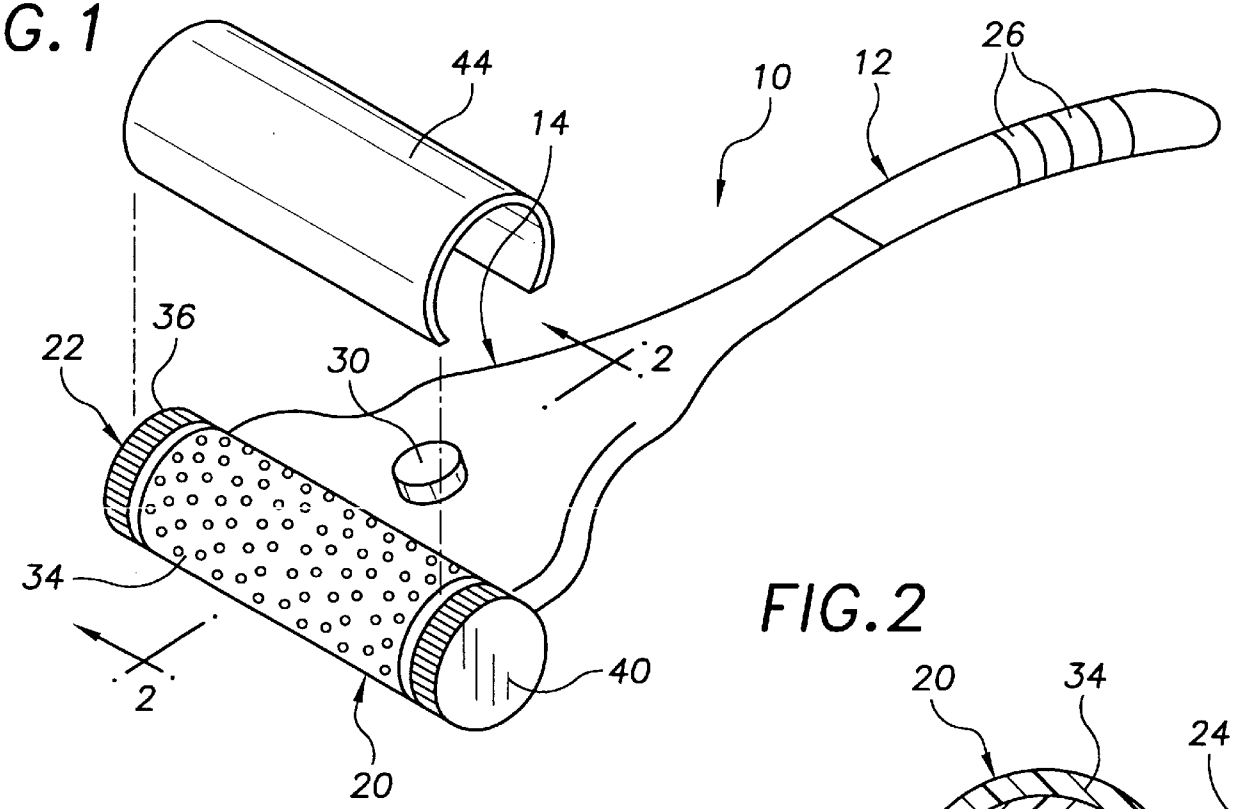
FIG. 1 is a perspective view of the present invention.
Figure 2:
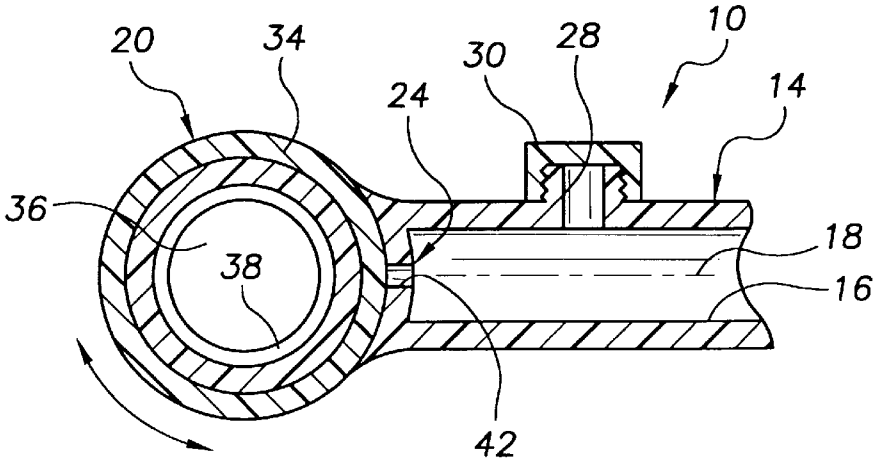
FIG. 2 is a cross sectional view taken alone line 2—2 in FIG. 1.

Turning now descriptively to the drawings, in which similar reference characters denote similar elements throughout the several views, FIGS. 1 and 2 illustrate the various features of the present invention being a lotion dispensing system 10 comprising a handle 12. A housing 14 at a bottom end of the handle 12 has a reservoir 16 therein for holding lotion 18. An applicator roller assembly 20 is provided. A structure 22 is for rotatively mounting applicator roller assembly 20 to a lower end of housing 14. Facility 24 distributes the lotion 18 from reservoir 16 within housing 14 to applicator roller assembly 20, for application onto a human body upon contact with applicator roller assembly 20.

The handle 12 is slightly curved and includes ergonomic telescoping sections 26 operable between collapsed and extended positions, so as to extend the length of handle 12 for easier access to portions of the human body. Housing 14 includes a opening 28 for reservoir 16 and a removable cover 30 to fit over fill opening 28. Applicator roller assembly 20 consists of a replaceable tubular shaped sponge member 34.

Rotatively mounting structure 22 comprises a stationary cap 36 on a first side of lower end of housing 14. Stationary cap 36 has an inwardly facing collar 38 to receive tubular applicator roller assembly 20 thereover, while allowing applicator roller assembly 20 to revolve thereabout. A removable cap 40 engages with inwardly facing collar 38 to allow for for easy removal of applicator roller assembly 20 for cleaning and replacement.

The lotion distributing facility 24 includes housing 14 having longitudinal slot 42 along the length of lower end, so that applicator roller assembly 20 fitting snugly up against a longitudinal slot 42 will be evenly coated by the lotion 18 as applicator roller assembly 20 rotates at lower end of housing 14. The lotion dispensing system 10 can further contain a slip-on protective cover 44 to protect applicator roller assembly 20 from picking up dirt and other contaminates when not in use.

It can be seen from the preceding description that in use, one who desires to apply lotion 18 to their body will simply fill reservoir 16 in housing 14 with desired lotion 18, extend telescoping handle 12 to the length required and enjoy the benefit of being able to quickly and easily apply lotion 18 to any part of their body without the need of assistance. In the event that applicator roller assembly 20 become dirty, removable cap 40 can be detached, allowing tubular shaped sponge member 34 to be easily cleaned or replaced. Use of lotion dispensing system 10 will provide a very practical and inexpensive way of allowing anyone to apply lotion 18 to their body in the home, at the pool or at the beach. The lotion dispensing system 10 is especially beneficial to the elderly or to a person who lives alone.

It is noted that the embodiment of the lotion dispensing system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A lotion dispensing system comprising:

a handle;

a housing at a bottom end of said handle having a reservoir therein for holding lotion;

an applicator roller assembly;

means for rotatively mounting said applicator roller assembly to a lower end of said housing;

means for distributing the lotion from said reservoir within said housing to said applicator roller assembly for application onto a human body upon contact with said applicator roller assembly; and a slip-on protective cover to protect said applicator roller assembly from picking up dirt and other contaminates when not in use;

said handle being slightly curved and including ergonomic telescoping sections operable between collapsed and extended positions, so as to extend the length of said handle for easier access to portions of the human body;

said housing including a fill opening for said reservoir and a removable cover to fit over said fill opening;

said lotion distributing means includes said housing having a longitudinal slot along the length of said lower end, so that said applicator roller assembly fitting snugly so against said, longitudinal slot will be evenly coated by the lotion as said applicator roller assembly rotates at said lower end of said housing.

* * * * *